US008196538B2

(12) United States Patent
Orford

(10) Patent No.: US 8,196,538 B2
(45) Date of Patent: Jun. 12, 2012

(54) MOORING AID

(76) Inventor: Robert Baker Orford, Bury St. Edmunds (GB)

( * ) Notice: Subject to any disclaimer, the term of this patent is extended or adjusted under 35 U.S.C. 154(b) by 138 days.

(21) Appl. No.: 12/530,026

(22) PCT Filed: Mar. 6, 2008

(86) PCT No.: PCT/GB2008/000769

§ 371 (c)(1),
(2), (4) Date: Jan. 4, 2010

(87) PCT Pub. No.: WO2008/107681

PCT Pub. Date: Sep. 12, 2008

(65) Prior Publication Data

US 2010/0107955 A1 May 6, 2010

(30) Foreign Application Priority Data

Mar. 6, 2007 (GB) ..... 0704274.0

(51) Int. Cl.
*B63B 21/00* (2006.01)

(52) U.S. Cl. ..... 114/230.25

(58) Field of Classification Search ..... 114/230.25, 114/230.1, 230.11, 230.14, 230.2; 441/3
See application file for complete search history.

(56) References Cited

U.S. PATENT DOCUMENTS

| | | | | |
|---|---|---|---|---|
| 2,440,972 | A * | 5/1948 | Peltier | 114/230.19 |
| 2,558,174 | A | 6/1951 | Flink | |
| 2,640,534 | A * | 6/1953 | Coffing | 160/62 |
| 3,151,595 | A * | 10/1964 | Stainbrook | 114/230.25 |
| 4,143,613 | A | 3/1979 | Paul | |
| 4,676,182 | A | 6/1987 | Chaiko | |
| 5,154,132 | A * | 10/1992 | Brushaber | 114/230.11 |
| 5,364,075 | A | 11/1994 | Montgomery | |
| 6,578,509 | B1 | 6/2003 | Brushaber | |
| 6,662,740 | B1 * | 12/2003 | Noe et al. | 114/230.11 |
| 2008/0039242 | A1 * | 2/2008 | Nye | 473/483 |

* cited by examiner

*Primary Examiner* — Lars A Olson
*Assistant Examiner* — Andrew Polay
(74) *Attorney, Agent, or Firm* — Burr & Brown

(57) ABSTRACT

This invention relates to a mooring aid for use at marine installations, such as jetties and the like, wherein the mooring aid comprises a support (2), a member (18) which is mounted to the support (2) and to which a mooring rope can be detachably secured, wherein the member (18) is moveable reciprocally between a retracted position which corresponds to a storage position for the rope secured thereto and an extended position which renders a rope secured thereto accessible to a user. Wherein the mooring aid preferably further comprises biasing means (7, 8, 9, 10, 11) for urging the member (18) from its external position to its retracted position, wherein the biasing means may be housed in the support (2).

12 Claims, 6 Drawing Sheets

MOORING AID

This invention relates to a mooring aid for use at marine installations, such as jetties and the like.

Accordingly, the invention provides a mooring aid comprising:

a support; and a member which is mounted to the support and to which a mooring, rope can be detachably secured, wherein the member is movable reciprocably between a retracted position which corresponds to a storage position for a rope secured thereto and an extended position which renders a rope secured thereto accessible to a user.

Preferably, the support comprises means, such as biasing means, for urging the member from its extended position to its retracted position. Any such biasing means may comprise a spring having an end attached to the member, preferably one end thereof, which member is preferably elongate and, in use, projects from the support in, say, a generally horizontal plane.

Preferably, the biasing means may be housed within the support.

In an embodiment of mooring aid to be described in more detail hereinbelow, any such biasing means, such as a spring, is connected to the support by a flexible elongate element, such as a rope, which extends around a pulley attached to the biasing means and which has one end attached to the member and its other end anchored to the support.

Further preferably, the biasing means may be a weight attached to the pulley.

In the embodiment, the support also comprises a tubular upright in which the biasing means, flexible elongate member and associated pulley are housed, with the other end of the biasing means being anchored to the lower end of the upright.

The urging means may comprise any other suitable arrangement, for example, a hydraulic or pneumatic piston/cylinder arrangement connected between the member and support.

A mooring rope may be detachably secured to the member, preferably at an end thereof adjacent the support, by any suitable means, such as a cable clamp(s). Such a rope may have one end secured to a jetty or the like, with the other end of the rope being detachably secured to the member, as discussed above.

Alternatively, and in the embodiment, two ends of a single length of mooring rope are detachably secured to the member, with the rope extending through a rope jammer of known construction.

With this particular arrangement of embodiment, and when the member is in its extended position and the two ends of the mooring rope have been detached therefrom by a user on a boat, one end of the rope can be tied to the boat and the other end of the rope can be used to pull the boat towards the support and hence an associated jetty or the like to which the support is mounted rigidly, with the rope moving through the jamming means until the boat is suitably moored. Thereafter, the jamming means prevents the rope from moving therethrough in the opposite direction, thereby retaining the boat at its mooring.

Preferably, any elongate member to which a mooring rope is detachably securable, is flexible, in order to facilitate handling by a user, and may be made of any suitable material, such as, fibreglass, carbon fibre, a plastics material or any combination thereof.

To assist the member in returning from its extended position to its retracted position with respect to the support under bias, namely, when released by a user, the support may be provided with a guide for that purpose.

The support and/or member may be provided with at least one additional clamp to which one or more runs of a mooring rope may be secured detachably.

In order that the invention may be more fully understood, a mooring aid in accordance therewith will now be described by way of example and with reference to the accompanying drawings in which.

Figure 1:
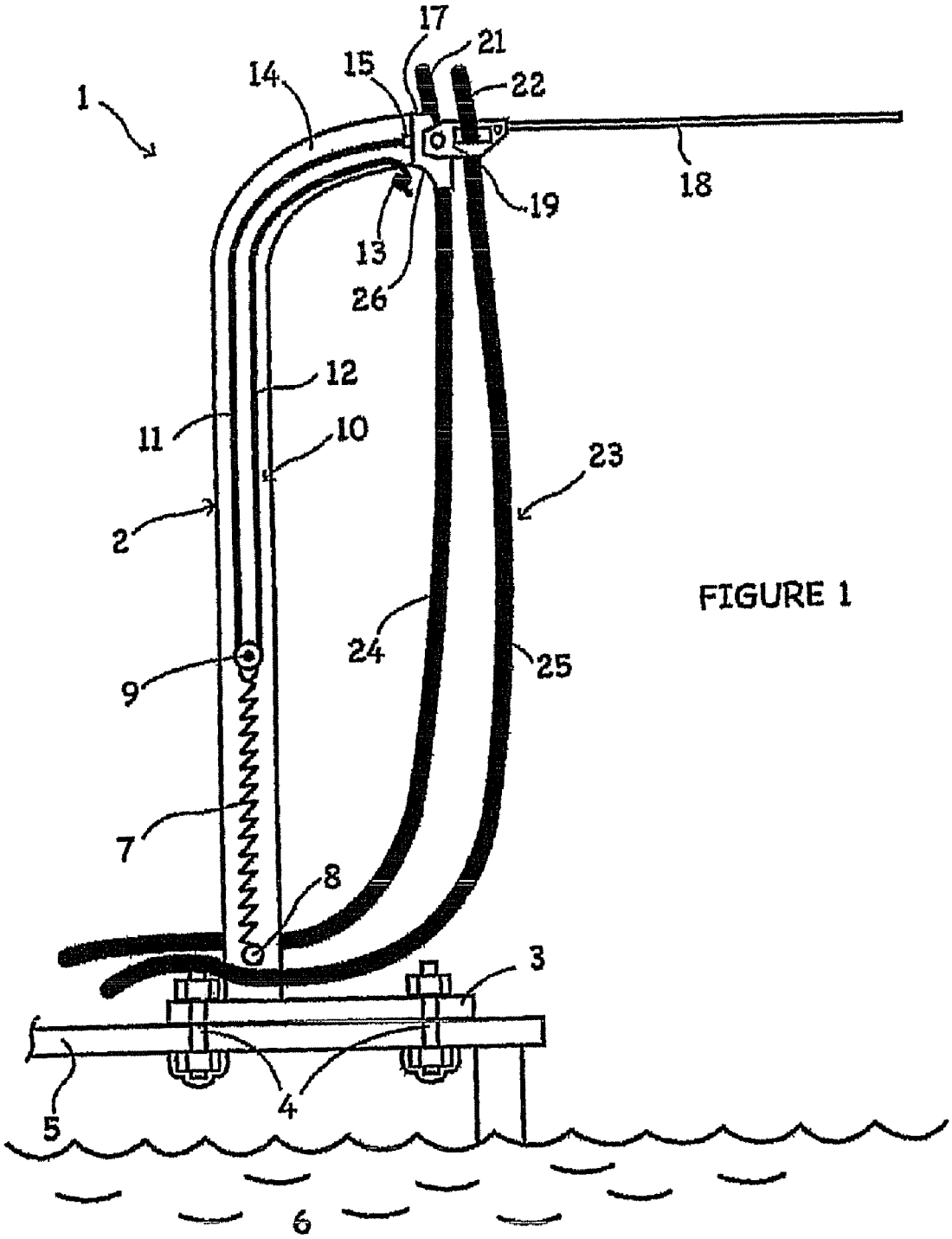
FIG. 1 is an elevational view of a mooring aid mounted to the decking of a jetty, with mooring rope present according to one embodiment of the present invention.
Figure 2:
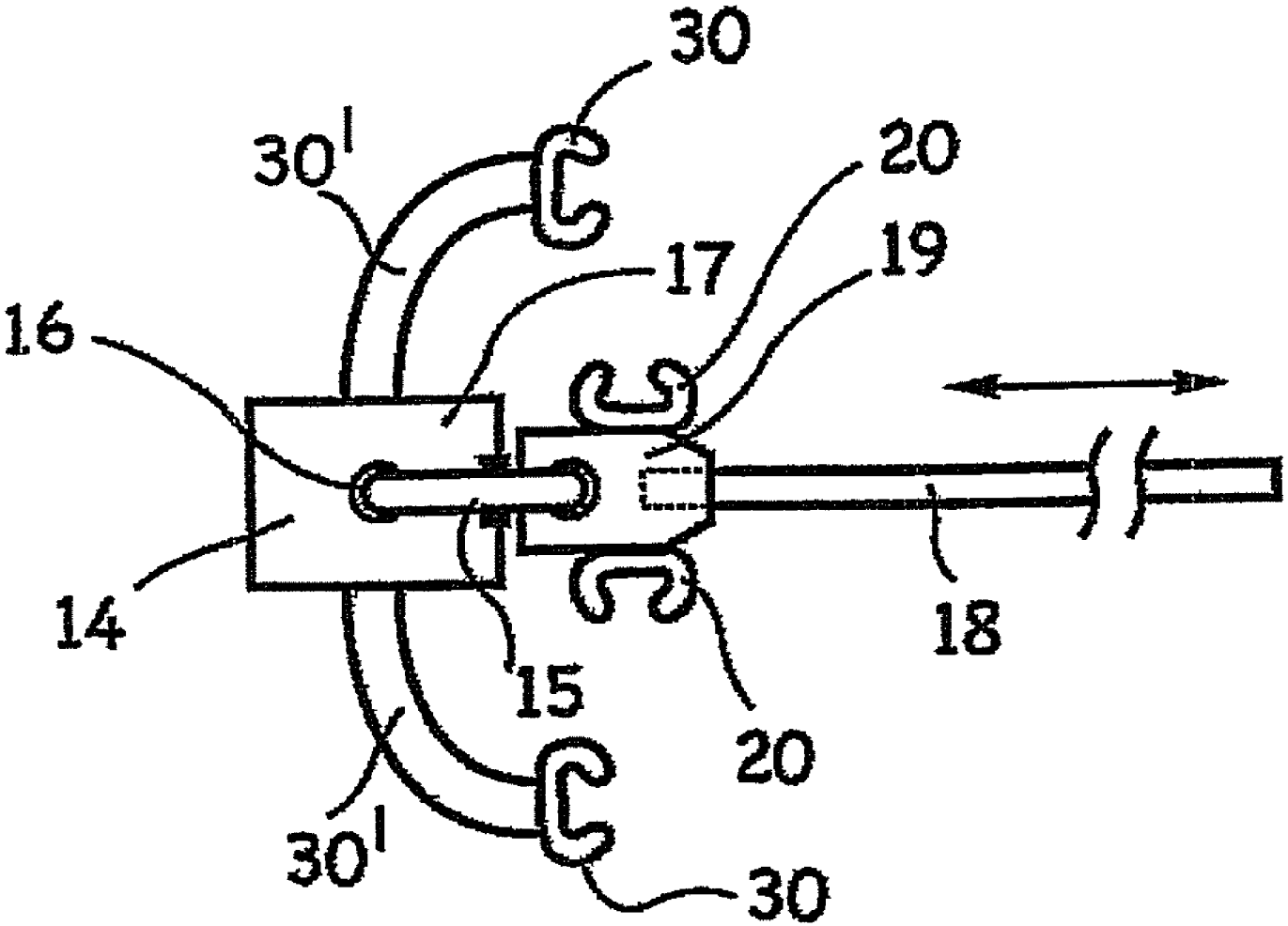
FIG. 2 is a plan view of the mooring aid of FIG. 1, with mooring rope absent.

Referring firstly to FIGS. 1 and 2 of the accompanying drawings, a mooring aid, as indicated generally at 1, comprises an upright, tubular support 2 having at its lower end a base 3 which is bolted at 4 to the decking 5 of a jetty extending over a body of water 6.

A tension spring 7 has its lower end attached at 8 to the lower end of the upright support 2, with its upper end connected to a pulley 9.

A length of rope, indicated generally at 10, extends around the pulley 9 in two runs 11, 12.

The upper end 13 of the rope run 12 is attached to the arcuate upper end 14 of the upright support 2, whilst the upper end 15 of the other rope run 11 extends through a hole 16 in a closure 17 for the upper arcuate end of the support 2.

The upper free end of the rope run 11 attached to a horizontally-extending, flexible rod 18 via a bracket 19, which rod 18 may be made from any suitable flexible material, such as, fibreglass, carbon fibre, steel, a plastics material or any combination thereof.

On opposed sides of the bracket 19 are provided respective rope clamps 20 in which are received the free ends 21, 22 of a length of mooring rope indicated generally at 23.

The length of mooring rope 23 extends through a jamming device, as will be described herein below, and effectively has two vertical runs 24, 25 extending up to respective bracket clamps 20.

In FIGS. 1 and 2, the flexible rod 18 is shown in its retracted position with respect to the support, with the ends 21, 22 of the length of rope 23 in a storage position.

When a boat user wishes to moor his/her boat at the jetty, the boat is brought sufficiently close to the mooring aid 1, so that the user can grasp the flexible rod 18, usually at the free end thereof.

When ready, the user then pulls the rod 18 outwardly and away from the upper end 14 of the support 2, taking with it the associated bracket 19 and free ends 21, 22 of the respective mooring rope runs 24, 25.

The rod 18 is now in an extended condition with the rope ends 21, 22 accessible to the user.

Simultaneously, the rope 10 is pulled around the pulley 9, such that the upper end of the rope run 11 is pulled through the hole 16 in the support closure 17, whereby the pulley 9 is pulled upwardly in the support 2, to extend the length of the spring 7 and place it under tension.

Now that the rod 18 is in its extended condition, the user can grasp and remove the rope ends 21, 22 from their respective clamps 20 on the bracket 19.

As shown in FIG. 2, two additional rope clamps are mounted on either side of the upper end 14 of the support 2 by arcuate arms 30', for having one or more further runs of the length of mooring rope 23 detachably secured thereto.

One rope end, say, end 22, is then secured to the boat, whilst the other rope end 21 is used to pull the boat along side the jetty, with the rope 23 passing through the jamming device freely but being prevented from moving in the opposite direction, thereby ensuring that the boat is moved steadily toward the jetty and, subsequently, can be moored there securely.

Once the mooring rope ends 21, 22 are removed from their clamps 20, the user can release his/her grasp upon the rod 18 which then returns to its retracted condition with respect to the upper end 14 of the support 2 under the bias of the tensioned spring 7. A guide 26 is provided at the upper end 14 of the support 2, to facilitate return of the rod 18 to its proper retracted condition with respect thereto.

Figure 3:
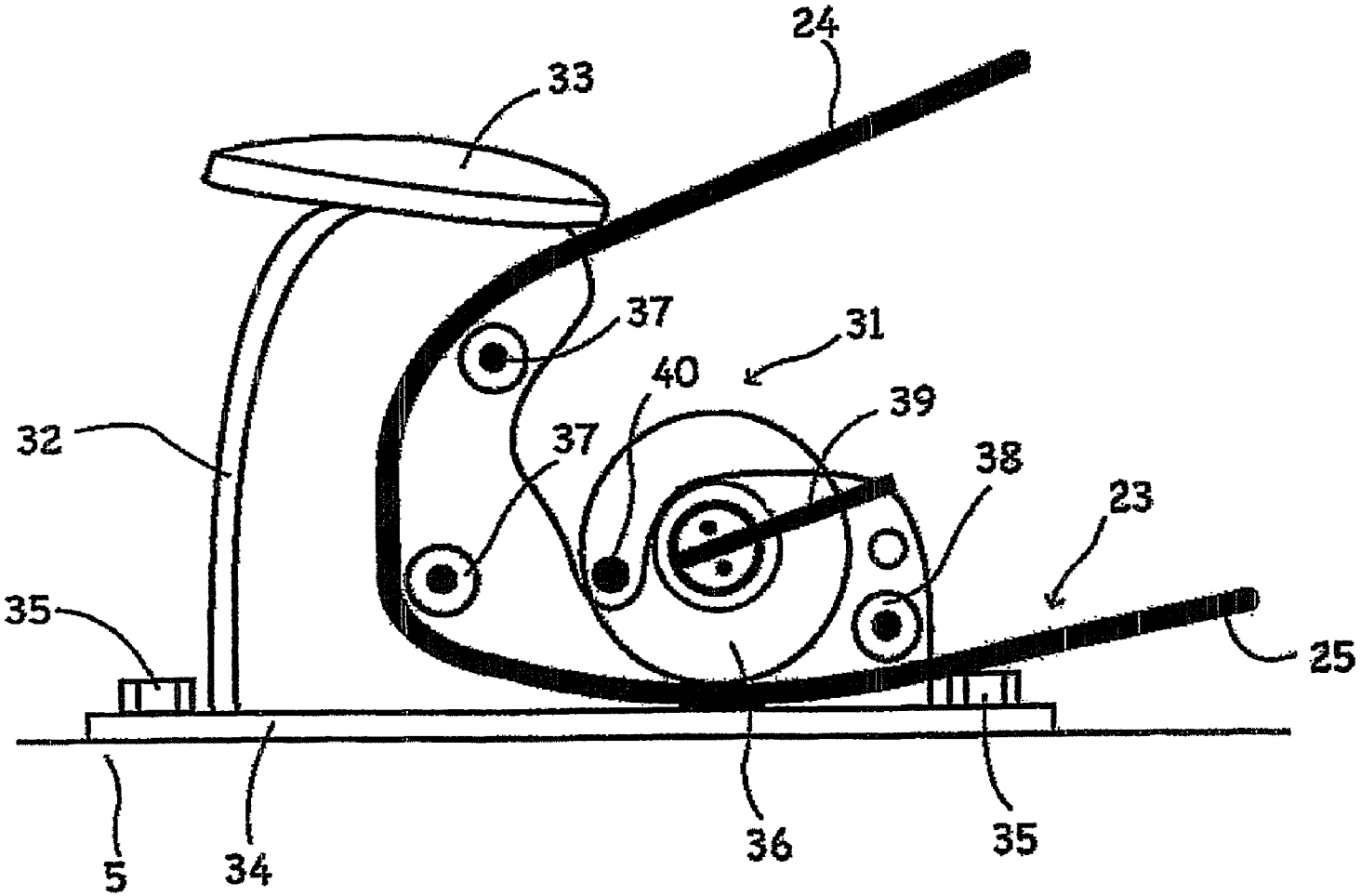
FIG. 3 is an elevational view of a conventional 10 type of rope jammer for use with the mooring aid of FIGS. 1 and 2.

In FIG. 3 of the drawings, there is shown a conventional type of jamming device indicated generally at 31 and comprising a body 32 provided with a tying-off cleat 33 at its upper end. The body 32 of the cleat 31 is mounted to a base plate 34 which is bolted at 35 to decking 5 or other firm horizontal support surface.

The length of rope 23 passes through the jamming device 31 between a serrated, off-set cam 36 and the base plate 34 and around a pair of pulleys or rollers 37. A further pulley or roller 38 acts as a guide for the rope run 25 entering the jamming device 31 and a lever 39 is provided for releasing the jamming device 31, when required. Also, another lever 40 can be used to turn the offset cam 36, to prevent jamming.

This jamming device 31 can be used with the mooring aid 1 and can be located remote there from or adjacent the aid 1 itself, for example, immediately beneath the upper arcuate end 14 of the upright support 2 on the jetty decking 5.

Figure 4:
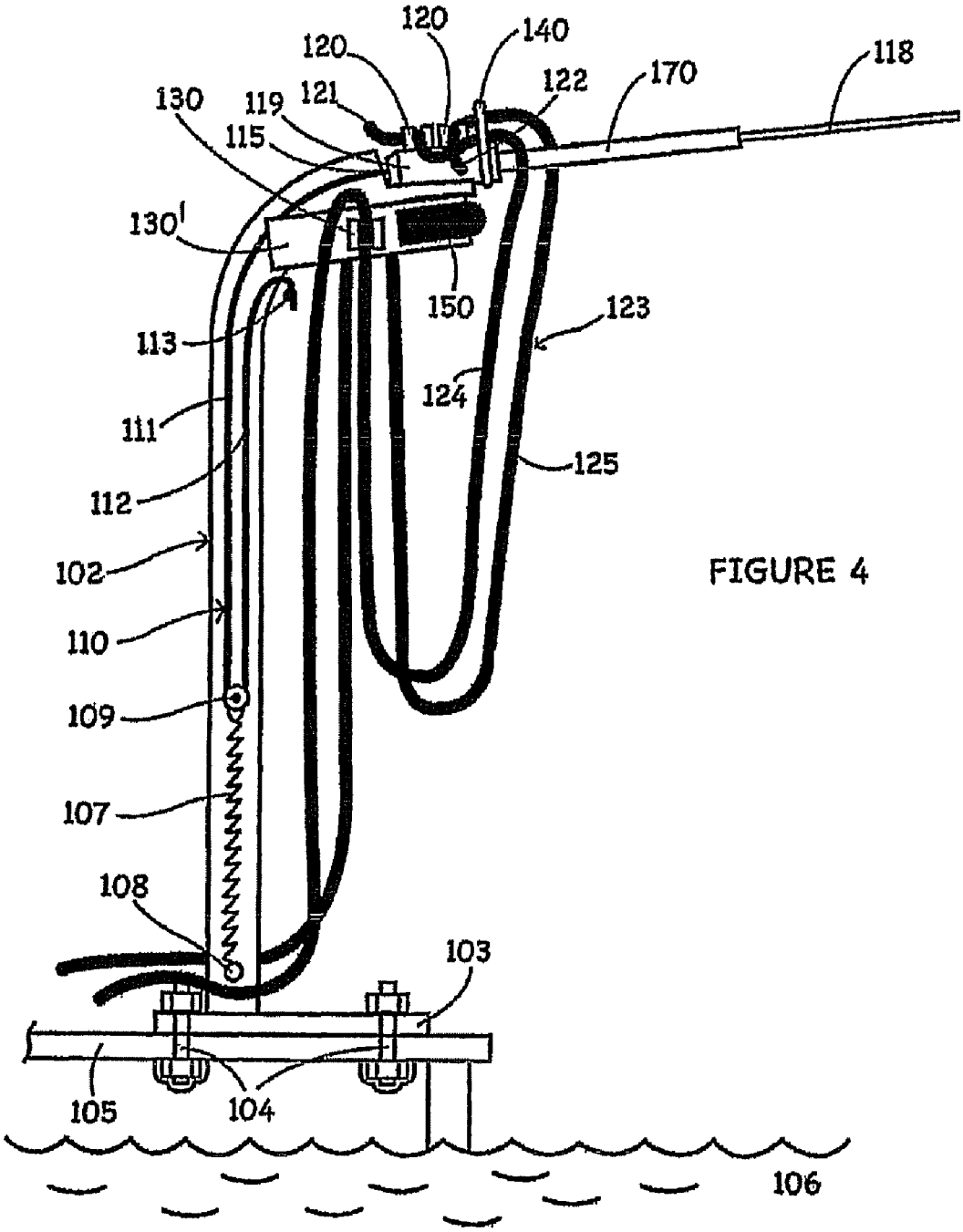
FIG. 4 is an elevational view of a mooring aid mounted to the decking of a jetty, with mooring rope present according to a second embodiment of the present invention.
Figure 5:
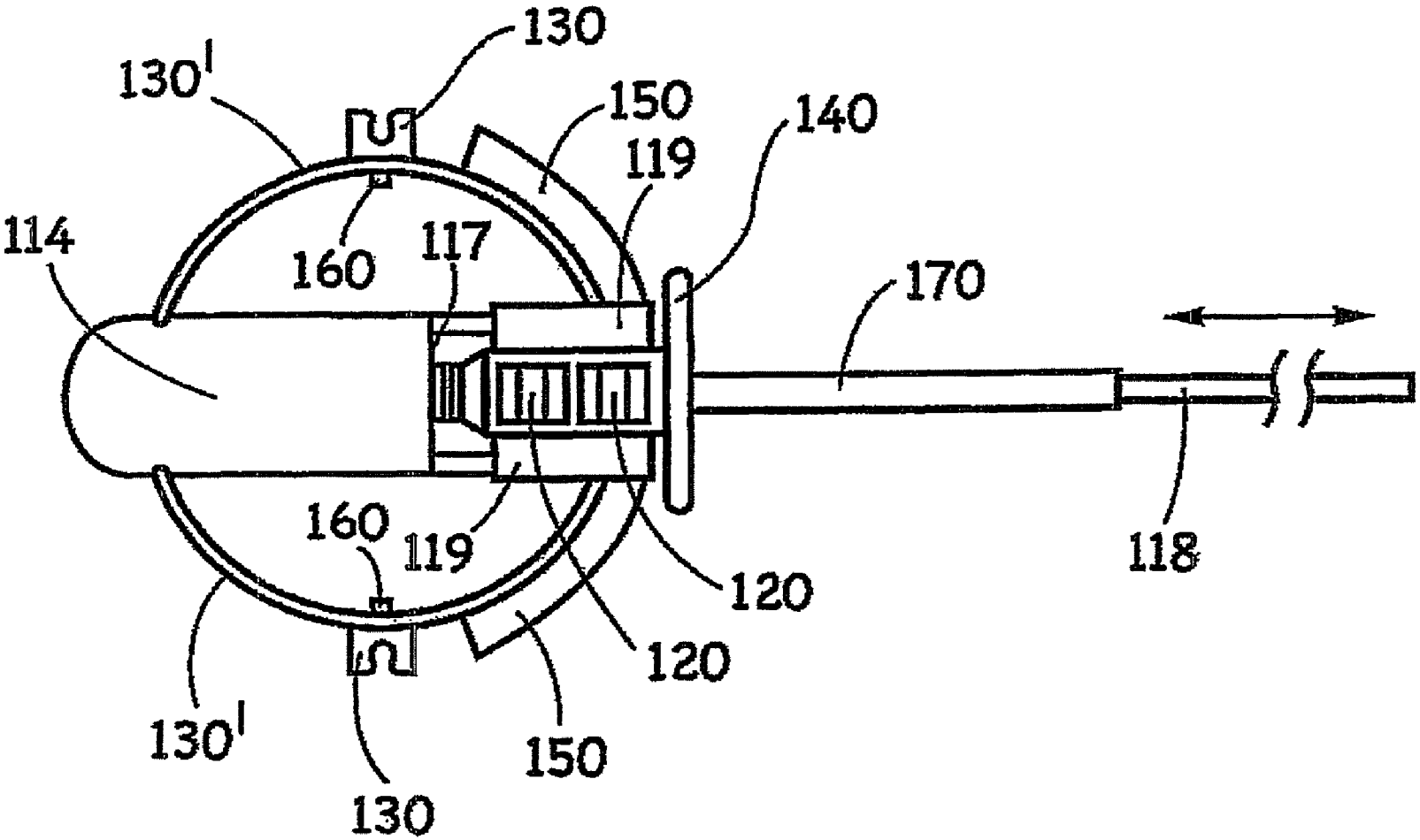
FIG. 5 is a plan view of the mooring aid of FIG. 4, with mooring rope absent.
Figure 6:
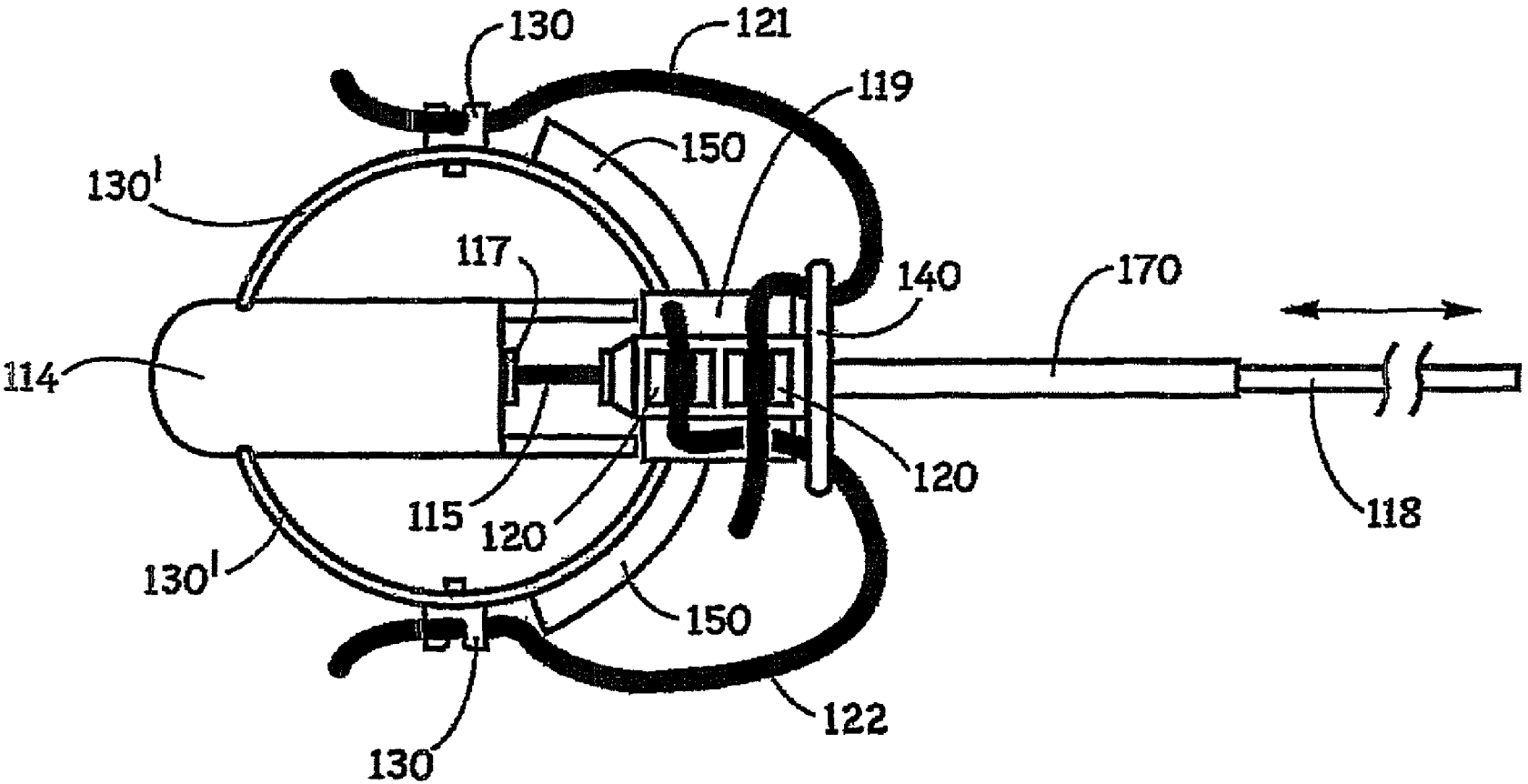
FIG. 6 is a plan view of the mooring aid of FIG. 5 in an extended position, with mooring rope present.

FIGS. 4, 5 & 6 describe a mooring aid of second embodiment of the present invention. The same numbering is used throughout these Figures where appropriate.

FIG. 4 is an elevational view of a mooring aid mounted to the decking of a jetty, with mooring rope present according to a second embodiment of the present invention. There is shown a mooring aid, as previously described with reference to FIGS. 1 & 2, which comprises an upright, tubular support 102 having at its lower end a base 103 which is bolted at 104 to the decking 105 of a jetty extending over a body of water 106.

A tension spring 107 has its lower end attached at 108 to the lower end of the upright support 102, with its upper end connected to a pulley 109.

A length of rope, indicated generally at 110 extends around the pulley 109 in two runs 111, 112.

The upper end 113 of the rope run 112 is attached to the arcuate upper end 114 of the upright support 102, whilst the upper end 115 of the other rope run 111 extends through a hole (not shown) in a closure (not shown) for the upper arcuate end of the support 102.

The upper free end of the rope run 111 is attached to a horizontally-extending, flexible rod 118 via a bracket 119, which rod 118 may be made from any suitable flexible material, such as, fibreglass, carbon fibre, steel, a plastics material or any combination thereof. The rod 118 further comprises a sprung supporting member 170 for further flexibility.

On the top of the bracket 119 are provided respective rope clamps 120 in which are received the free ends 121, 122 of a length of mooring rope indicated generally at 123.

The length of mooring rope 123 effectively has two vertical runs 124, 125 extending up to respective rope clamps 120. The two vertical runs 124, 125 also run through a rope guide 140 which helps to stop them getting tangled.

As shown in FIG. 4, two additional rope clamps 130 are mounted on either side of the upper end of the support 102 by arms 130', for having one or more further runs of the length of mooring rope 123 detachably secured thereto. A rubber buffer 150 is also provided.

In FIG. 4, the flexible rod 118 is shown in its retracted position with respect to the support 102, with the ends 121, 122 of the length of rope 123 in a storage position. The mooring aid of FIG. 4 works in operation in the same way as the mooring aid of FIG. 1.

FIG. 5 is a plan view of the mooring aid of FIG. 4, with mooring rope absent. There is shown the upper end 114 of the upright support 102 of the mooring aid of FIG. 4, and the closure 117, as well as the bracket 119, the rod 118 and sprung supporting member 170.

On the top of the bracket 119 there can be seen the rope clamps 120 in which are received the free ends of the mooring rope in operation. The rope guide 140 can also be seen.

The two additional rope clamps 130 are mounted on either side of the arcuate arms 130' using nuts and bots 160. The rubber buffer 150 can also be seen which protects the arms 130' from the boat.

In FIG. 5, the flexible rod 118 is shown in its retracted position with respect to the support.

FIG. 6 is a plan view of the mooring aid of FIG. 5 in an extended position, with mooring rope present. There is shown the upper end 114 of the upright support 102 of the mooring aid of FIG. 4, and the closure 117, as well as the bracket 119, the rod 118 and sprung supporting member 170.

On the top of the bracket 119 there can be seen the rope clamps 120 in which are received the free ends 121, 122 of the mooring rope in operation. The rope guide 140 can also be seen.

The two additional rope clamps 130 are mounted on either side of the arcuate arms 130'. The rubber buffer 150 can also be seen which protects the arms 130' from the boat.

In FIG. 6, the flexible rod 118 is shown in its extended position with respect to the support, therefore the upper end 115 of the rope run 111 of FIG. 4 can also be seen extending through the closure 117 and attached to the bracket 119.

In another embodiment the biasing means could be provided by a weight attached to the pulley 9, which would replace the spring 7. The weight moving upwards towards the top of the support when the member is pulled into an extended position by a user and when the pulling force is released, the weight drops back down under the force of gravity and is sufficient to return the member back to its original retracted position.

The height of the mooring aid in the previous embodiments is approximately 1.4 meters, but it can be taller if required for bigger boats. All metal parts are either stainless or galvanised.

The mooring aid is ideal for either sail or power boats and allows the sailor to moor up without leaving the boat. This allows for greater control and much more time to attach lines, thus safer mooring. Further, lines can be acquired even when the boat is approx 1.8 meters from the pontoon/jetty. The mooring aid provides forward and aft lines together or independently and makes short or even single handed mooring easy. The boat can be moored bow or stern to and when not in use the flexible member can be conveniently stored in vertical position. The mooring aid also clamps to standard decking normally without any alterations and maybe fitted in less than 30 minutes in most circumstances.

It is to be appreciated that the present invention provides a mooring aid which allows a user to moor a boat to a jetty or the like without having to disembark from the boat, whilst not being limited to the embodiment described above. Also, it can be used in any appropriate marine application, whilst facilitating mooring and casting-off procedures.

The invention claimed is:

1. A mooring aid comprising:

a support;

a member which is mounted to the support and to which a mooring rope can be detachably secured; and means for urging the member from an extended position to a retracted position, wherein:

the member is movable reciprocably between the retracted position which corresponds to a storage position for a rope secured thereto and the extended position which renders a rope secured thereto accessible to a user, the member is elongate and projects from the support in a generally horizontal plane in said storage position, the member is mounted to the support at a height such that the member projects from the support in order for a user to be able to grasp the member, the member is arranged to be grasped by a user and pulled outwardly and away from the support and wherein a mooring rope is arranged to be detachably secured to the member at an end thereof adjacent the support in the retracted position, said urging means comprises a biasing means for urging the member from the extended position to the retracted position, the biasing means is housed within the support, and said biasing means is connected to the support by a flexible elongate element which (1) extends around a pulley attached to said biasing means, (2) has one end attached to the member, and (3) has an other end anchored to the support.

2. A mooring aid according to claim 1, wherein said biasing means comprises a spring having an end attached to the member.

3. A mooring aid according to claim 1, wherein said biasing means comprises a weight.

4. A mooring aid according to claim 1, wherein the support comprises a tubular upright in which said biasing means, said flexible elongate member and said pulley are housed, with a lower end of said biasing means being anchored to the lower end of the upright.

5. A mooring aid according to claim 1, wherein said urging means comprises a hydraulic or pneumatic piston and cylinder arrangement connected between the member and support.

6. A mooring aid according to claim 1 comprising further a cable clamp to which a mooring rope is securable detachably.

7. A mooring aid according to claim 1, wherein at least one of said support and said member includes at least one additional clamp to which one or more runs of a mooring rope can be secured detachably.

8. A combination comprising:

a marine installation:

a mooring aid according to claim 1 and mounted to the marine installation; and a mooring rope secured detachably to the mooring aid.

9. A combination according to claim 8, wherein both ends of the mooring rope are secured detachably to the mooring aid, with the rope extending through a rope jammer anchored to the marine installation.

10. A mooring aid according to claim 1, wherein the member can be grasped by a user and pulled away from an upper end of the support, taking with it an associated bracket and a free end of a mooring rope.

11. A mooring aid according to claim 1, wherein the member comprises a flexible rod.

12. A mooring aid according to claim 1, wherein the member is movable to a stored position in which the member is in a vertical position.

* * * * *